US006451117B1

(12) United States Patent
Farquhar et al.

(10) Patent No.: US 6,451,117 B1
(45) Date of Patent: Sep. 17, 2002

(54) PAINT MASK AND A METHOD FOR UTILIZING THE SAME

(75) Inventors: Gary Farquhar, Farmington Hills, MI (US); Malgorzata M. Skender, Birmingham, MI (US)

(73) Assignee: Ford Global Tech., Inc., Dearborn, MI (US)

( * ) Notice: Subject to any disclaimer, the term of this patent is extended or adjusted under 35 U.S.C. 154(b) by 91 days.

(21) Appl. No.: 09/636,684

(22) Filed: Aug. 11, 2000

(51) Int. Cl.[7] ..... B05C 21/00
(52) U.S. Cl. ..... 118/504
(58) Field of Search ..... 118/635, 629, 118/301, 406, 504; 239/123, 690, 690.1, 694, 697; 427/282

(56) References Cited

U.S. PATENT DOCUMENTS

| | | | | |
|---|---|---|---|---|
| 4,156,040 A | | 5/1979 | Swider et al. | |
| 4,290,383 A | * | 9/1981 | Pfender | 118/326 |
| 4,679,525 A | | 7/1987 | Curtze | |
| 4,704,987 A | | 11/1987 | Curtze | |
| 4,716,270 A | | 12/1987 | Gnanamuthu et al. | |
| 4,974,532 A | * | 12/1990 | March | 118/301 |
| 5,091,647 A | | 2/1992 | Carduner et al. | |
| 5,175,018 A | | 12/1992 | Lee et al. | |
| 5,717,233 A | * | 2/1998 | Fujii et al. | |
| 5,830,274 A | * | 11/1998 | Jones et al. | 118/620 |

FOREIGN PATENT DOCUMENTS

| | | |
|---|---|---|
| EP | 0822011 A2 | 2/1998 |
| EP | 0633069 B1 | 9/1998 |
| GB | 2351682 A | 1/2001 |
| JP | 61164668 | 7/1986 |
| JP | 06010000 | 8/1995 |
| WO | WO 98/58745 | 12/1998 |

OTHER PUBLICATIONS

Imanishi, M.; Ikeda, O.; Hanada, K.; Kabeshita, A.; New Circuit Patterning Technology "Painting System"; Dated Feb. 1990; Published in Japan; vol. 36; No. 1; National Technical Report.

* cited by examiner

*Primary Examiner*—Laura Edwards
(74) *Attorney, Agent, or Firm*—Ford Global Tech., Inc.

(57) ABSTRACT

A non-contact mask 10 which is selectively deployed in close proximity to an object 12 and which has a certain type of electrical charge. A substance 16, to be selectively applied to the object 12, is provided with the certain type of electrical charge and the electrical charge of the mask 10 and the electrical charge of the substance 16 cooperate to substantially prevent the substance 16 from being applied to the mask 10.

15 Claims, 1 Drawing Sheet

PAINT MASK AND A METHOD FOR UTILIZING THE SAME

FIELD OF THE INVENTION

The present invention generally relates to a paint mask and more particularly, to a non-contact paint mask and a method for utilizing the same which allows different colors of paint to be selectively and efficiently applied to a vehicle or other object.

BACKGROUND OF THE INVENTION

Paint masks are typically used to mask or cover portions of an object, such as a vehicle, which are not to receive paint or some other substance. In this manner and by the selective and sequential use of these masks, an object may selectively receive many different colors of paint in order to achieve an overall aesthetically pleasing appearance.

Typically, these prior assemblies protect the vehicle by actually receiving and "contacting" the paint or other substance, thereby preventing the paint (or other substance) from being applied to the covered or protected portion of the vehicle. Since these prior assemblies actually receive the paint (or other substance) they are often referred to as "contact assemblies".

While these contact type masks do selectively protect a vehicle (or other object) from contact with a substance, such as paint, they suffer from some drawbacks. For example, these contact type masks are adapted to receive the paint or other applied substance, thereby causing these masks to become unsightly and to cause the received substance to be undesirably transferred to any other object that subsequently contacts these masks, including another vehicle to which the masks are later applied. To address this drawback, these masks must be frequently cleaned (i. e. , after each use) and allowed to thoroughly dry, thereby requiring a storage facility, relatively large amounts of such masks, and undesirably complicating the overall painting process.

To address these drawbacks, a non-contact mask assembly (i.e., a mask assembly which is not adapted to substantially or actually receive or contact the applied substance) has been created and utilizes relatively high velocity air which is directed in the general vicinity of the mask assembly and that portion of an object which is to be protected (i.e., which is not to receive the paint or other substance). The relatively high velocity air generally disrupts the flow of the substance by creating turbulent type eddy currents or vortexes within the substance flow pattern, thereby causing the material to be unevenly distributed or applied to the object and causing a relatively non-aesthetically pleasing overall appearance to be achieved. The turbulence may even cause the applied substance to be deposited on portions of the object which are to be protected and upon the mask assembly itself.

There is therefore a need for a new and improved mask and a method for utilizing the mask which overcomes at least some of the previously delineated drawbacks of prior assemblies.

SUMMARY OF THE INVENTION

It is a first object of the present invention to provide a method and an apparatus which overcomes at least some of the previously delineated drawbacks of prior mask assemblies and methods.

It is a second object of the present invention to provide a method and an apparatus which overcomes at least some of the previously delineated drawbacks of prior masks and mask assemblies and which electrostatically and non-contactingly repels paint or other substances from an object, such as a vehicle.

It is a third object of the present invention to provide a method and an apparatus which overcomes at least some of the previously delineated drawbacks of prior masks and mask assemblies and which electrostatically repels paint or other substances from an object, such as a vehicle, in a substantially non-contact manner.

According to a first aspect of the present invention, an electrostatic non-contact mask is provided.

According to a second aspect of the present invention, a method for placing a substance onto an object is provided. The method comprises the steps of providing a mask; electrically charging the mask by the use of a first type of electrical charge on the mask; electrically charging the substance by the use of the first type of electrical charge; placing the mask in close proximity to a portion of the object; and applying the electrically charged substance to a second portion of the object.

These and other features, aspects, and advantages of the present invention will become apparent to those of ordinary skill in the art from a reading of the following detailed description of the preferred embodiment of the invention and by reference to the following drawings.

DETAILED DESCRIPTION OF THE PREFERRED EMBODIMENT OF THE INVENTION

Figure 1:
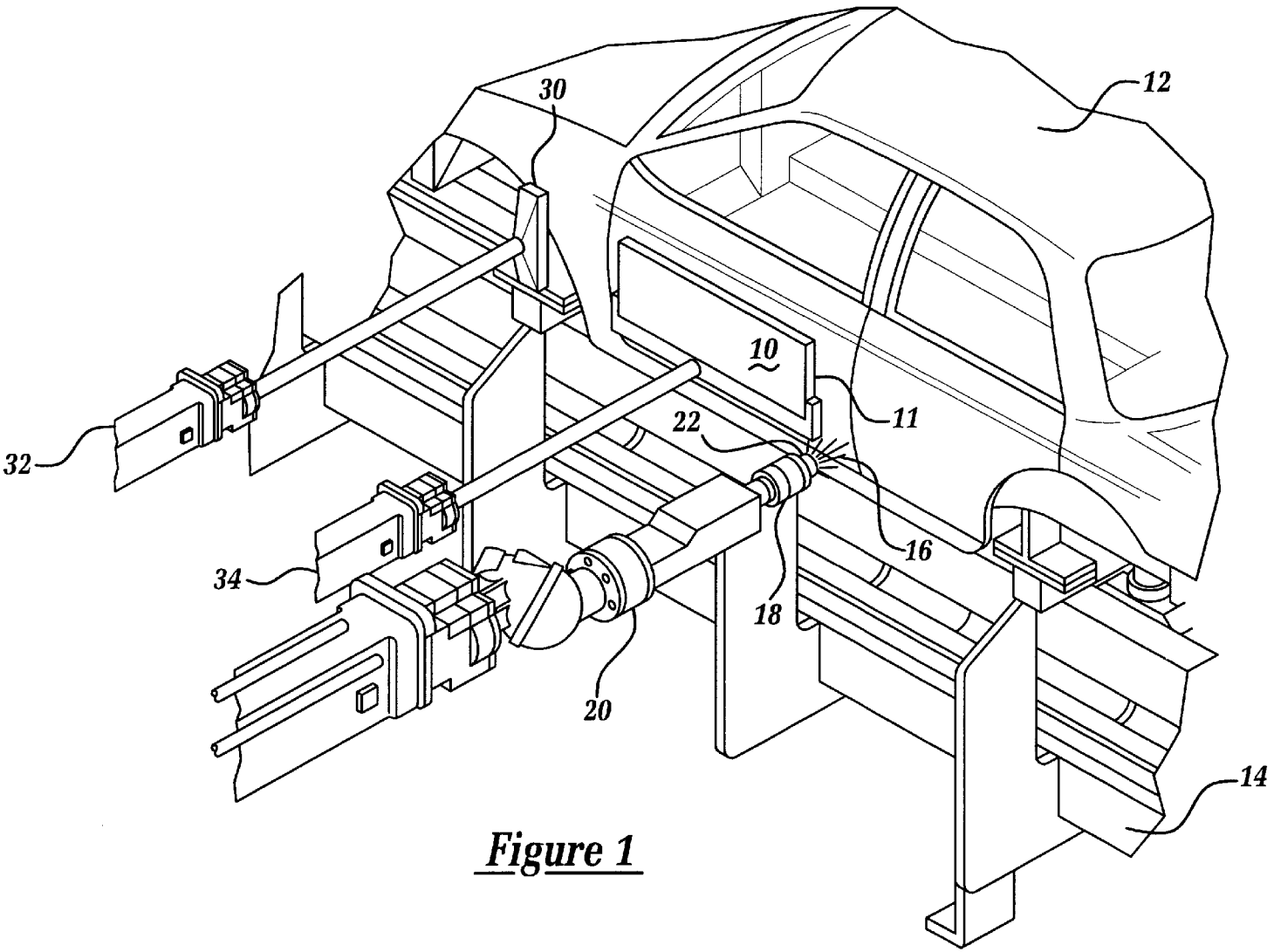
FIG. 1 is a partial perspective view of a paint mask assembly which is made in accordance with the teachings of the preferred embodiment of the invention and which is deployed upon a portion of a vehicle which is to receive paint or another substance.

Referring now to FIG. 1, there is shown a mask 10 which is made in accordance with the teachings of the preferred embodiment of the invention. As shown, mask 10 is movably deployed in close proximity to a portion 11 of the body of a vehicle 12, and the vehicular body 12 is deployed upon a selectively movable conveyor assembly 14. In one non-limiting embodiment, mask 10 is held by a selectively movable robotic arm 34 and continues to substantially cover portion 11 as the body 12 moved due to the operation conveyor 14. Mask 10 may also be movable deployed in close proximity to portion 11 by other devices other than robotic arms. It should be appreciated that while the following discussion describes the use of a single mask 10 with a vehicle 12 in combination with paint, mask 10 may be selectively "applied to" (e.g., used with) a wide variety of other diverse objects and selectively used in combination with a wide variety of diverse substances, other than paint. Hence, the invention is not limited to use with paint or a vehicle. Further, while mask 10 is shown, in FIG. 1, to be generally rectangular, others shapes and configurations may be used. In the most preferred embodiment of the invention, mask 10 is created by the use of relatively thin copper material, having a thickness of about 0.02 inches. Other materials and thicknesses may be utilized.

Mask 10 therefore protects the certain portion 11 of the vehicle 12 from receiving paint in a "non-contact" manner (e.g., paint does not substantially contact mask 10 or portion 11) and the operation of mask 10 is described in greater detail below.

That is, paint 16 is applied to the vehicle 12 by the use of conventional paint bells 18 which may be deployed upon a selectively movable robotic arm 20. In the preferred embodiment of the invention, both the paint 16 and the mask 10 are electrically charged and, more particularly, the mask 10 and the paint 16 have the same electrical charge (e.g., the mask 10 and the paint 16 are both negatively charged or they are both positively charged). The portion of the arm 34 holding the mask 10 may also have the same electric charge as the mask 10 or may be sufficiently removed from the flow 22 of the paint 16 so as to create a relatively low probability of contact from occurring between the portion of the arm 34 which holds the mask 10 and the paint 16. The conveyor assembly 14, upon which the vehicle 12 resides is attached to an electrical ground potential in a conventional manner. A relatively low charge is applied to the mask 10 and the thin copper allows this low charge to be efficiently applied by use of relatively low power.

The electrical charge of the applied paint 16 cooperates with the electrical charge of the mask 10 to substantially prevent the paint 16 from being deposited upon the mask 10 and mask 10 therefore protects the portion 11 of the vehicle 12 from receiving the paint in a non-contact manner (e.g., the respective and substantially similar electrical charges repel the paint 16 from the mask 10). The substantially similar charge (if any) of the arm 34 and the paint 16 similarly and substantially prevents contact between the paint 16 and the portion of the arm 34 holding the mask 10. It should be appreciated that the bells 18 may reside at substantially any desirable angle with respect to the vehicle 12 and that the mask 10 may be placed upon a robotic arm or other selectively movable member and "travel with" the moving bell 16, or in other applications, may be statically or stationarily deployed with respect to the conveyor assembly 14.

In an alternate embodiment of the invention, the mask 10 is cleaned after each use by a cleaning member 30 which is attached to a selectively movable arm or member 32. Member 30 may, in yet another alternate embodiment of the invention comprise a roller type member. Hence, it should be appreciated that the cooperating electrical charges allow the portion 11 to be substantially protected from the paint 16, allow the paint 16 to be substantially prevented from being deposited upon the mask 10, and achieve these desirable objectives without the creation of turbulence and vortexes within the flow pattern 22 of the paint 16, thereby allowing the paint to be evenly distributed upon vehicle 12 in an aesthetically pleasing manner.

In yet another non-limiting embodiment of the invention, mask 11 may form or comprise a roll which is held by a first robotic arm and which is selectively pulled or extended by a second robotic arm to allow portions of the mask 10 to be selectively utilized upon objects at varying intervals of time. The roll may later be cleaned.

It is to be understood that the invention is not limited to the exact construction or method which has been illustrated and described above, but that various changes and modifications may be made without departing from the spirit and the scope of the inventions as are further delineated in the following claims.

What is claimed is:

1. An electrically charged mask which is movably deployed between an object that receives an electrically charged certain substance and an emitter of said certain substance, wherein said mask has the same electrical charge as said certain substance which substantially prevents said certain substance from contacting said mask.

2. The mask of claim 1 wherein said mask has a positive electrical charge.

3. The mask of claim 1 wherein said mask has a negative electrical charge.

4. The mask of claim 1 wherein said mask is generally rectangular.

5. The non-contact mask of claim 1 wherein said mask has a certain electrical charge which substantially prevents a certain substance from contacting said non-contact mask.

6. The mask of claim 1 wherein said certain substance comprises paint.

7. The mask of claim 1 wherein said mask is created from a relatively thin copper material.

8. The mask of claim 7 wherein said copper material has a thickness of about 0.02 inches.

9. A mask assembly comprising:

an electrically charged mask which is in close proximity to an object that receives an electrically charged certain substance, wherein said mask has the same electrical charge as said certain substance which substantially prevents said certain substance from contacting said mask; and a wiper assembly which selectively contacts said mask.

10. The mask assembly of claim 9 wherein said mask is positively charged.

11. The mask assembly of claim 9 wherein said mask is negatively charged.

12. The mask of claim 9 wherein said mask is created from relatively thin copper material.

13. The mask of claim 12 wherein said copper material has a thickness of about 0.2 inches.

14. The mask of claim 9 wherein said mask is generally rectangular.

15. The mask of claim 9 wherein said mask has a certain electrical charge which substantially prevents a certain substance from contacting said non-contact mask.

* * * * *